United States Patent [19]

Minesinger et al.

[11] 4,009,793

[45] Mar. 1, 1977

[54] TAMPER-PROOF CLOSURE SEAL

[75] Inventors: David Ellsworth Minesinger, Fort Thomas; Thomas Foster Leslie, Covington, both of Ky.

[73] Assignee: The Procter & Gamble Company, Cincinnati, Ohio

[22] Filed: Apr. 15, 1976

[21] Appl. No.: 677,340

Related U.S. Application Data

[63] Continuation of Ser. No. 488,103, July 12, 1974, abandoned.

[52] U.S. Cl. ..... 215/246; 206/498; 215/232; 215/255; 220/359; 229/51 AS

[51] Int. Cl.[2] ..... B65D 41/54

[58] Field of Search ..... 229/51 S, 51 AS; 206/498, 497; 215/246, 232, 254, 255, 256, 257; 220/270, 279, 359

[56] References Cited

UNITED STATES PATENTS

| | | | |
|---|---|---|---|
| 1,221,911 | 4/1917 | Ruysdael | 229/51 AS |
| 1,557,653 | 10/1925 | Carvalho | 215/256 |
| 1,987,596 | 1/1935 | Cox | 229/51 AS |
| 2,005,665 | 6/1935 | Saignier | 229/51 S |
| 2,118,849 | 5/1938 | Lindsey | 229/51 AS |
| 3,095,103 | 6/1963 | Harrison | 215/246 |
| 3,387,739 | 6/1968 | Rohowetz | 220/279 |
| 3,519,193 | 7/1970 | Palmer | 206/498 |
| 3,844,861 | 10/1974 | Irish, Jr. | 215/246 |
| 3,873,018 | 3/1975 | Donnay | 229/51 TS |

FOREIGN PATENTS OR APPLICATIONS

| | | | |
|---|---|---|---|
| 1,194,016 | 6/1970 | United Kingdom | 229/51 AS |

*Primary Examiner*—Stephen P. Garbe
*Assistant Examiner*—Bruce H. Bernstein
*Attorney, Agent, or Firm*—Elliot A. Lackenbach; John V. Gorman; Richard C. Witte

[57] ABSTRACT

Tamper-proof closure seal for containers such as bottles, cans, and the like and methods of tamper-proofing and manufacturing tamper-proof closure seals which preclude inadvertent openings of product containers, readily indicate to prospective consumers that a product container has been opened or tampered with and which yet still enables easy intentional opening of such product containers.

1 Claim, 13 Drawing Figures

Fig. 1
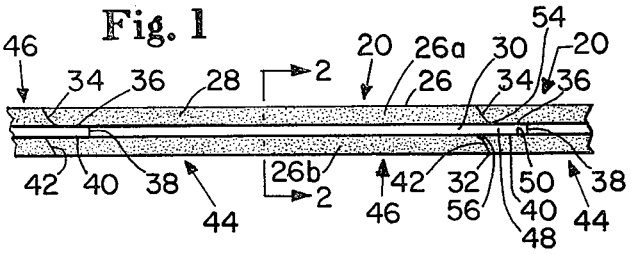
Fig. 3
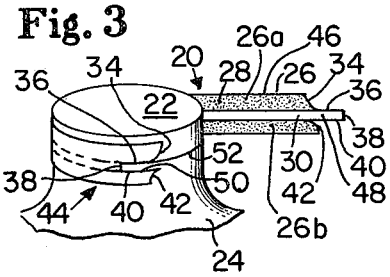
Fig. 2
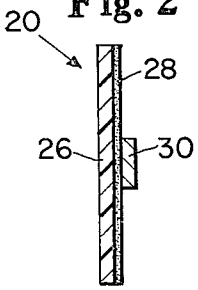
Fig. 4
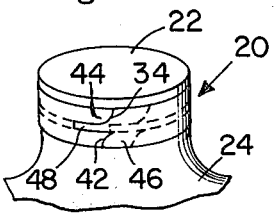
Fig. 5
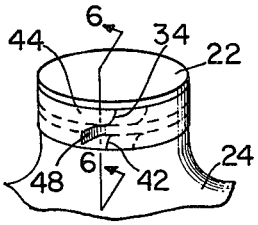
Fig. 6
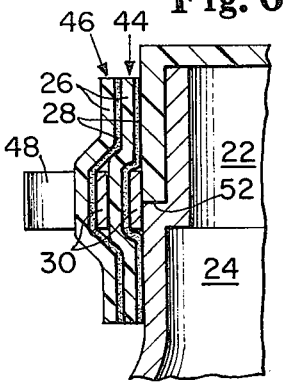
Fig. 7
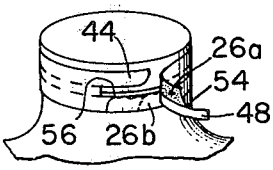
Fig. 8
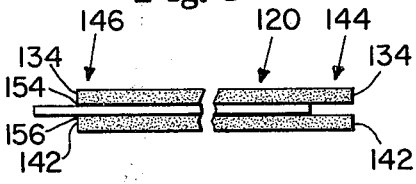
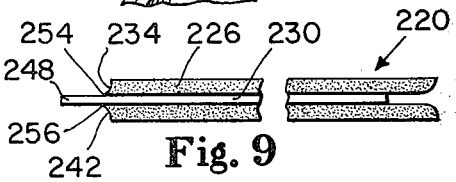
Fig. 9
Fig. 10
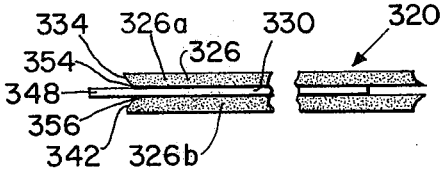
Fig. 11
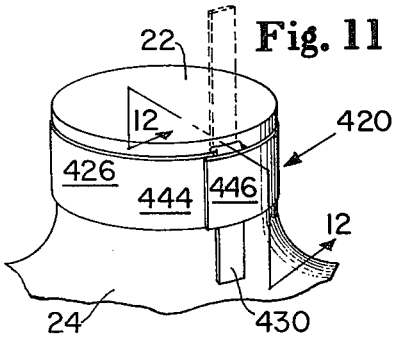
Fig. 12
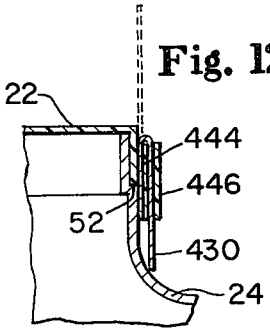
Fig. 13
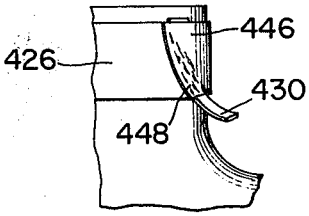

TAMPER-PROOF CLOSURE SEAL

This is a continuation of application Ser. No. 488,103, filed July 12, 1974, now abandoned.

FIELD OF THE INVENTION

This invention relates to tamper-proof closure seals and sealing of product containers, and the like.

DESCRIPTION OF THE PRIOR ART

It has been heretofore suggested to provide a tamper-proof band joining a container such as a bottle of can and a closure therefor by wrapping a heat-shrinkable adhesive tape circumferentially applied overlapping portions of the closure skirt and the container and then applying heat thereto to shrink the tape to form a tightly adherent conforming band therearound.

Tamper-proof devices of this nature, however, are subject to a number of distinct deficiencies. Firstly, such temper-proof devices do not include any provision for easy opening and location of the band overlap by a consumer is difficult. Accordingly, removal of this type of tamper-proof band is usually accomplished by peeling the band from the jar only after locating and loosening of the trailing end of the overlap by the consumer or by the consumer having to cut the band with a knife. Secondly, where the band has been peeled from the jar by locating and loosening of the trailing end, it is in some instances possible for the tamper-proof band to be reapplied or a substitute therefor be applied utilizing a stretchy adhesive tape so that the prior removal of the tamper-proof band will not be readily obvious to a later prospective consumer.

OBJECTS AND SUMMARY OF THE INVENTION

It is, therefore, a primary object of the present invention to provide a novel and improved tamper-proof closure seal which may be easily opened by a consumer while yet being secure in that it is not susceptible to any substantial likelihood of being inadvertently removed and if once removed cannot be readily replaced.

Another primary object of the present invention, in addition to the foregoing object, is the provision of a novel and improved tamper-proof closure seal in the form of a band provided with a tab for peeling of the band prior to removal of the closure.

Still another primary object of the present invention, in addition to each of the foregoing objects, is the provision of novel and improved tamper-proof closures, seals comprising a band with a tear tab for peeling thereof wherein the tab is easily located by a consumer.

Yet another primary object of the present invention, in addition to each of the foregoing objects, is the provision of novel and improved tamper-proof closure seals comprising a tamper-proof band provided with an opening device which is easily locatable and identifiable for peeling the band prior to removal of the closure.

Yet still another primary object of the present invention, in addition to each of the foregoing objects, is the provision of novel and improved opening devices for tamper-proof bands which may be readily located and grasped by a consumer for peeling of the band.

Another and further primary object of the present invention, in addition to each of the foregoing objects, is the provision of novel and improved tamper-proof closure seals capable of signaling tampering to a consumer.

A yet still further primary object of the present invention, in addition to each of the foregoing objects, is the provision of novel and improved tamper-proof closure seals providing an unopened look to a package which cannot be restored once the tamper-proof closure seal has been partially or completely removed.

Another and yet still further primary object of the present invention, in addition to each of the foregoing objects, is the provision of novel and improved methods of providing tamper-proof closure seals and of tamper-proofing a container and closure therefor.

Another and still furhter primary object of the present invention, in addition to each of the foregoing objects, is the provision of novel and improved methods and apparatus for tamper-proof closure sealing in accordance herewith.

SUMMARY OF THE IVENTION

The invention resides in the combination, construction, arrangement, disposition and materials of the various component parts and elements incorporated in improved tamper-proof closure seals and in methods thereof in accordance with the principles of this invention. The present invention is better understood and objects and important features other than those specifically enumerated above will become apparent when consideration is given to the following details and description, which when taken in conjunction with the annexed drawing describes, discloses, illustrates and shows certain preferred embodiments or modifications of the present invention and what is presently considered and believed to be the best mode of practicing the principles thereof. Other embodiments or modifications may be suggested to those having the benefit of the teachings herein, and such other embodiments or modifications are intended to be reserved especially if they fall within the scope and spirit of the subjoined claims.

In accordance with the present invention, there is provided seal apparatus for positioning around the rim of a container cap overlapping an adjacent portion of the container to provide tamper-proof means for securing such closure non-movable relative such container and comprising, in combination, a length of heat shrinkable adhesive tape and a non-heat shrinkable tear strip masking an end portion thereof to provide a pull tab therefore and which may have a width substantially less than the width of the heat shrinkable adhesive tape and extend generally along the adhesive surface of the tape, being positioned generally medially transversely of the tape to expose the adhesive along both edges thereof for bonding with the adjacent portion of the closure and the container surfaces, respectively, and positioned generally longitudinally offset thereof with the adhesive tape being notched at the end portion to the width of the tear strip to provide a non-adherent pull tab projecting longitudinally outwardly thereof to curl to project outwardly upon heat shrinking of the tape to enable it to be easily gripped by a consumer for peeling and removal of the tamper-proof seal.

BRIEF DESCRIPTION OF THE DRAWING

Although the specification concludes with claims particularly pointing out and distinctly claiming the subject matter regarded as forming the present invention, it is believed the invention will be better understood and objects and important features other than those specifically enumerated above will become apparent from the hereinafter set forth detailed description of the invention taken in conjunction with the annexed drawing, in which:

FIG. 1 is a plan view of a tamper-proof closure seal in accordance with the present invention illustrating how such seal may be severed from a continuous strip;

FIG. 2 is an enlarged cross-sectional elevational view taken along line 2—2 of FIG. 1;

FIG. 3 is a perspective illustration showing a step in the application of the tamper-proof closure seal of FIG. 1 to a container such as a bottle;

FIG. 4 is a perspective illustration similar to FIG. 3 showing a further step in the application of the tamper-proof closure seal of FIG. 1 to the bottle;

FIG. 5 is a perspective illustration similar to the preceding figures showing the tamper-proof closure seal in its completed configuration;

FIG. 6 is an enlarged cross-sectional elevational view taken along lines 6—6 of FIG. 5;

FIG. 7 is a perspective illustration similar to the preceding views showing the tamper-proof closure seal being peeled away to allow the container to be opened and the closure removed;

FIGS. 8, 9, and 10, respectively, are plan illustrations of further embodiments or modifications of tamper-proof closure seals in accordance with the present invention.

FIG. 11 is a perspective illustration similar to FIG. 4 illustrating a further embodiment or modification of a tamper-proof closure seal in accordance with the present invention at an intermediate stage in the application thereof to a bottle;

FIG. 12 is a cross-sectional partial elevational view taken along line 12—12 of FIG. 11; and FIG. 13 is a partial elevational view of the tamper-proof closure seal of FIGS. 11 and 12 as fully formed and disposed on a bottle.

DETAILED DESCRIPTION OF THE INVENTION

With reference now to the drawing, and particularly to FIGS. 1 – 7 thereof, there is shown and illustrated a tamper-proof closure seal designated generally by the reference character 20 which may be utilized to provide tamper-proof sealing of a closure or cap 22 to a container or bottle 24.

The closure seal 20 comprises a length of heat shrinkable adhesive tape 26 having a pressure sensitive adhesive layer 28 and a non-heat shrinkable or thermally dimensionally stable tear strip 30 adhered to a portion of the heat shrinkable adhesive tape 26.

With particular reference to FIG. 1, the closure seal 20 may be formed by severing from continuous strips of material defining the adhesive tape 26 and the tear strip 30. For example, the tear strip 30 may be adhered generally longitudinally extending along the adhesive tape 26 generally laterally centrally thereof and the laminated structure formed thereby then severed along a generally transversely extending cutline 32 defined by interconnected cutline segments 34, 36, 38, 40, and 42 defining complementary leading and trailing end configurations 44 and 46, respectively, and thereby generally longitudinally offsetting the tear strip 30 relative the adhesive tape 26.

As heretofore pointed out, the non-heat shrinkable tear strip 30 is laterally medially positioned on the heat shrink adhesive tape 26 and may, as shown, be generally centrally located thereon so that the cutline portions 34 and 42 are of substantially equal length and terminate at the side or lateral edges of the tear strip with the cutline portions 36 and 40 being generally straight and extending along the respective side edges of the tear strip 30. The cutline portion 38 extends generally transversely across and through the tear strip 30 generally offset from the cutline portions 34 and 42 so as to define a tab portion 48 trailing outwardly of the body of the closure seal 20 and, incidentally, a corresponding notch 50 in the leading edge portion 44 of the closure seal 20.

Furher; as is now believed to be clear from the foregoing description, the adhesive 28 of the tab portion 48 is substantially completely masked by the overlying poriton of the tear strip 30 and the tab 48 consists essentially of a laminate having an outer layer formed by the heat shrink adhesive tape 26 and an inner layer formed by the non-heat shrinkable tear strip 30 bonded together substantially entirely by the adhesive layer 28. The remainder of the closure seal 20, however, comprises side edge portions 26*a* and 26*b* extending entirely longitudinally thereof which consists essentially of the heat shrinkable adhesive tape 26 with the adhesive 28 thereof exposed.

With particular reference now to FIG. 3, the tamper-proof closure seal 20 may be applied to maintain a closure, such as a cap 22 on a container, such as a bottle 24 by being wrapped around to overlap the interface therebetween, indicated generally by the reference character 52. The leading edge portion 44 may be adhered first, with each of the adhesive side portions of the closure seal 20 being adhered to the closure 22 and container 24, respectively, and with the tear strip 30 generally overlying the closure-container interface 52. As pointed out above, however, the tear strip 30 need not necessarily extend throughout the entire longitudinal extent of the closure seal 20, need not be laterally centered thereon, nor need the closure seal 20 necessarily be centered over the closure-container interface 52. The closure seal 20 may be wrapped around the closure-container interface 52 and the trailing edge portion 46 overlapped across the leading edge portion 44, as shown in FIG. 4 to leave the tab 48 exposed and to cover the slot 50. The entire closure seal 20 may then be heated, as by hot air, radiant heating, or the like, to a temperature sufficient to enable relaxation and shrinkage of the heat shrink tape 26 to tighten the closure seal 20 on both the closure 22 and container 24 and to provide firm sealing thereof. While preferably the entire closure seal 20 is heated in such manner to tighten the closure seal 20, it is only critical to the present invention that at least the tab 48 be so heated and shrunk. Upon shrinkage of the heat shrink tape layer of the tab 48, the tab 48 will curl outwardly as shown in FIGS. 5 and 6 due to the differential shrinkage resulting from the shrinkage of the heat shrink tape 26 and the lack of shrinkage of the dimensionally heat stable and non-heat shrinkable tear strip 30 which, as has been stated, have been bonded together throughout the extent of the tab 48 by the layer of adhesive 28 therebetween. Hence, the tab 48 will be curled outwardly to provide a tab which may be readily and easily grasped by a consumer to enable the closure seal 20 to be peeled or torn to permit the closure 22 to be removed from the container 24. It will be understood, therefore, that the tear strip 30 must, particularly when laminated with the heat shrink tape 26 by the adhesive 28, provide a structure which is of sufficient strength to enable peeling or tearing of the closure seal 20.

In accordance with the present, the closure seal 20 may be either peeled, torn, or both torn and peeled to enable the closure 22 to be removed from the container 24. Moreover, the access mechanism, i.e., whether the closure seal 20 is to be torn, peeled, or both torn and peeled, but can be controlled by appropriate selection of the materials comprising the adhesive 28, the heat shrink tape 26 and the tear strip 30, as well as by control of the geometry of the closure seal in the region of the tab 48 and, particularly, by appropriate selection of the contour of the cutline portions 34 and 42 and the intersections 54 and 56 thereof with the cutline portions 36 and 40, respectively.

Hence, in the embodiment shown and illustrated in FIGS. 1–7, inclusive, the cut edge portion 34 of the trailing edge portion 46 is generally outwardly concave and the intersection 54 between the cutline portion 34 and the cutline portion 36 defining the side edge of the tab 48 is defined by a generally smooth and continuous curve. Conversely, the cutline portion 42 of the trailing edge portion 46 is generally outwardly and rearwardly convex and the intersection 56 thereof with the cutline portion 40 defining the other edge of the tab 48 defines a generally sharp notch extending inwardly and forwardly of the closure seal 20. Hence, upon outward pulling of the tab 48, the notch defined at 56 between the cutline portion 42 and the edge 40 of the tab 48 generates a high stress thereat while the lack of a stress raiser at the smoothly curved intersection 54 of the cutline portion 34 and the side edge 36 of the tab 48 produces a want tendency of the closure seal 20 to tear along the bottom edge of the tear strip 30 so that the tear strip 30 and upper portion **26*a* of the adhesive tape 26 peeled away from the closure 22, as shown in FIG. 7 while the lower portion 26*b* of the adhesive tape 26 tends to remain attached to the adjacent portion of the container 24. This tendency can be further controlled, as hereinbefore mentioned, by appropriate selection of the materials for the tear strip, the adhesive tape, and the adhesive. The geometry can, of course, be reversed to provide tearing on the top of the tear strip, and removal of the lower portion of the seal 20.**

With reference now to FIGS. 8, 9, and 10, there is shown and illustrated in each of these figures another embodiment or modification of closure seal constructed in accordance with the principles of the present invention. In each of the embodiments or modifications shown and illustrated in FIGS. 8, 9, and 10, respectively, like reference characters are used for like parts and elements as have been used hereinbefore with reference to FIGS. 1–7, except being preceded by the digit 1, 2, or 3, respectively. Hence, and with particular reference to FIG. 8, the closure seal shown illustrated therein is designated generally by the reference character 120; with particular reference to FIG. 9, the closure seal shown illustrated therein is designated generally by the reference character 220; and with particular reference to FIG. 10, the closure seal shown and illustrated therein is designated generally by the reference character 320. Each of the closure seals 120, 220, and 320 shown and illustrated in FIGS. 8, 9, and 10, respectively, are substantially similar in construction and detail to the closure seal 20 shown and illustrated in FIGS. 1–7 and hereinabove described in detail with the exception of the configurations of the leading and trailing edges thereof. Accordingly, only the details of the leading and trailing edges of the closure seals 120, 220, and 320, respectively, will be discussed hereinafter in detail, it being expressly understood that such details of the closure seals 120, 220, and 320 shown and illustrated in FIGS. 8, 9, and 10, respectively, which are not hereinafter discussed are substantially similar or identical to the like details of the closure seal 20 hereinabove described in detail and that description is incorporated herein by reference.

Accordingly, and now again particularly referring to FIG. 8, the closure seal 120 comprises generally square cut complementary leading and trailing edge portions 144 and 146, respectively, with the cutline portions 134, and 142 being generally transverse and perpendicular to the longitudinal axis of the closure seal 120 and in general alignment with one another. Accordingly, the intersections 154 and 156 comprise generally square corners as do the notches found thereby. It is to be understood, however, that the intersection 154 and 156 need not be specifically sharp and may comprise small radiuses, without departing from the scope of the present invention.

Moreover, the intersections 154 and 156 may, in fact, constitute substantial rounds, arcs or curves and, with particular reference now to FIG. 9, there is shown and illustrated therein a closure seal 220 wherein the cutline portions 134 and 142 both smoothly merge into generally curvilinear or arcuate intersections 254 and 256 to provide generally rearwardly and outwardly concave edges merging into the forward end of the tab 248 so as to substantially preclude any stress concentration or buildup along the edges of the tear strip 230 upon outward pulling of the tab 248 after completion of the closure seal. Hence, upon outward pulling of the tab 248 of the closure seal 220 there is little tendency for the adhesive tape 226 to split or tear and, accordingly, with proper selection of the adhesive and of the tape 226, the entire closure seal may be readily peeled outwardly for complete removal thereof.

Alternatively, and with particular reference now to FIG. 10, there is shown and illustrated therein a closure seal designated generally by the reference character 320 wherein the cutline portions 334 and 342 are generally forwardly and inwardly convex so that the intersections 354 and 356 are both quite sharp on each side of the tear strip 330 at the rearward edge of the tab 348 so that, again with appropriate selection of the adhesive and adhesive tape 326, tearing of the adhesive tape 326 along both edges of the tear strip 330 upon outward pulling of the tab 348 can be achieved to split the closure seal 320 into three portions whereby the adhesive of the central portion removed is substantially entirely masked by the tear strip 330 and the adhesive portions **326*a* and 326*b*** remained adhered to the closure and container, respectively.

In the embodiments or modifications hereinbefore described and disclosed, the non-heat shrink tear strip in each instance extended generally longitudinally of the heat shrinkable adhesive tape to define a pull-tab masked thereby of substantially smaller width than the width of the heat shrinkable adhesive tape. However, the tear strip which masks the adhesive to form the tab need not necessarily extend longitudinally of the heat shrinkable adhesive tape and may, in accordance with the present invention extend generally transversely thereof and may, therefore, mask an entire end portion of the heat shrink adhesive tape to form a substantially full width outwardly curled tab particularly useful where complete removal of the closure seal by peeling thereof is desired. Accordingly, and with reference now to FIGS. 11–13, inclusive, there is shown and illustrated yet another embodiment or modification of closure seal constructed in accordance with the principle of the present invention wherein like parts are designated by like reference characters as was utilized in the description and drawing of the preceding embodiments or modifications, with the reference characters being preceded by the digit 4. Hence, the closure seal shown and illustrated in FIGS. 11–13, inclusive, is designated generally by the reference character 420 and, as in the previous description, will not be hereinafter described in detail, being understood that those portions not described may be similar or identical to the corresponding portions of the heretofore described and disclosed closure seals.

In the closure seal 420, the tear strip 430 extends generally transversely of at least the rearward end portion 446 of the adhesive tape 420. Moreover, as shown, the tear strip 430 may also be adhered to the leading end portion 444 of the adhesive tape 426 and the closure seal 420 may be applied by, for example, initially adhering tear strip 430 to or adjacent the leading end portion 444 of the adhesive strip 426 projecting upwardly thereof as indicated in phantom in FIG. 12, wrapping the adhesive tape 426 around the intersection 52 between the closure 22 and container 24 and, simultaneously or at least prior to adhering the trailing end portion of the adhesive strip 446, bending or looping the tear strip 430 downwardly over the leading end portion 444 of the adhesive tape 426 and beneath the trailing end portion 446, as shown in solid lines in FIGS. 11 and 12. Then, upon heating of at least the trailing end portion 446 of the heat shrinkable adhesive tape 426, the laminated structure formed by the tear strip 430 masking and being bonded to the trailing end portion 446 of the adhesive tape 426 causes the trailing end portion 446 to curl generally upwardly and outwardly, as shown in FIG. 13 to define a pull-tab 448 enabling the closure seal 420 to be readily removed when desired.

As a further aid in locating the tab, the non-shrink tear strip may be colored to contrast with the remainder of the closure seal which color is at least partially exposed during shrinkage of the heat shrink tape. Moreover, the heat shrink tape may be of substantially any heat shrinkable material, for example, polyvinyl chloride, polyester, polyethylene, or the like. Similarly, the tear strip material may be substantially any material which is more dimensionally heat stable than the heat shrinkable pressure sensitive tape and may comprise, for example, wire, string, cellophane, polypropylene, and the like.

EXAMPLE 1

A glass jar having a metal screw cap was provided with a tamper-proof closure seal configured as shown in FIG. 8 laminated from ¾ inch wide polyethylene heat shrinkable pressure sensitive tape, Bear Brand No. 361 having a thickness of approximately 2½ mils, and a tear strip of 3/32 inch width two layer 140 MS cellophane laminated with a colored adhesive and commercially available from the Dow Chemical Company. The notch was formed to provide a tab approximately ½ inch long. The pressure sensitive tape was applied circumferentially to the closure skirt and the jar by hand with an overlap of approximately ⅜ to ½ inch and heat shrunk in a laboratory heat shrink tunnel. A successful tamper-proof closure seal resulted which precluded the cap from being unscrewed, while the outwardly curled tab could be readily grasped and the tamper-proof closure removed.

EXAMPLE 2

Tamper-proof closure seals configured as shown in FIG. 8 where constructed from ¾ inch wide translucent pressure sensitive heat shrinkable PVC tape manufactured by Minnesota Mining and Manufacturing Company identified as No. 6887 having a total thickness of 0.0035 inches and a strength of 40 pounds per inch of width exhibiting and adhesion to steel of 15 ounces per inch. A 3/32 inch wide polypropylene tear strip, identified as New England Printed Tape Company No. RS-T150 was laminated thereto as shown in FIG. 8 offset approximately ½ inch. The resultant closure seal was wrapped circumferentially around the cap and adjacent finish of a high density polyethylene bottle by hand and heat shrunk using a hot air gun. The resultant closures could not be twisted off with the tamper-proof closure seal intact yet the closure seals could be readily removed by pulling on the tab. The closure seals could not be reapplied after removal.

While the invention has been described, disclosed, illustrated and shown in terms of certain embodiments or modifications which it has assumed in practice, the scope of the invention should not be deemed to be limited by the precise embodiments or modifications herein described, disclosed, illustrated or shown, such other embodiments or modifications as may be suggested to those having the benefit of teachings herein being intended to be reserved especially as they fall within the scope and breadth of the claims here appended.

What is claimed is:

1. Seal apparatus extending around the rim of a container closure overlapping an adjacent portion of the container to provide tamper-proof means for securing such closure immovably relative such container comprising, in combination, a length of heat shrinkable adhesive tape having a leading end portion and a trailing end portion, said length of heat shrinkable adhesive tape being wrapped around and adhered to both the container and the closure extending across the interface therebetween with said trailing end portion overlapping said leading end portion and a non-heat shrinkable tear strip adhered to the adhesive tape beneath both said leading and trailing end portions thereof masking said adhesive thereat, said tear strip extending generally transversely across said leading end portion of said heat shrinkable adhesive tape beneath the adhesive face thereof, over a side edge of said leading edge portion and back across the non-adhesive face of leading edge portion beneath the adhesive face of said overlapping trailing end portion and generally laterally outwardly thereof defining a pull tab, said heat shrinkable adhesive tape having been heated and shrunk at least at said overlapping trailing end portion so that said pull tab is curled generally obliquely toward said side edge and outwardly of said closure and container.

* * * * *